United States Patent [19]

Strange

[11] 4,413,492

[45] Nov. 8, 1983

[54] DEADBOLT LOCK PROTECTOR

[76] Inventor: R. L. Strange, 944 London St., Menasha, Wis. 54952

[21] Appl. No.: 307,755

[22] Filed: Oct. 1, 1981

[51] Int. Cl.[3] ..... E05B 13/00

[52] U.S. Cl. ..... 70/416; 70/212; 70/256

[58] Field of Search ..... 70/416, 207, 209, 210, 70/211, 256

[56] References Cited

U.S. PATENT DOCUMENTS

| | | | |
|---|---|---|---|
| 3,563,069 | 2/1971 | Ferrer | 70/129 |
| 3,643,478 | 2/1972 | McPeake | 70/212 |
| 3,660,996 | 5/1972 | Syvertson | 70/209 |
| 3,921,423 | 11/1975 | Hollins | 70/416 |
| 4,064,721 | 12/1977 | Morgan | 70/416 |
| 4,279,137 | 7/1981 | Cook | 70/416 |

*Primary Examiner*—Robert L. Wolfe
*Attorney, Agent, or Firm*—Nicholas A. Kees

[57] ABSTRACT

A deadbolt lock protector including an outer metal enclosure, covering the lock, and attached to the door by means of non-removable screws. Inside the enclosure is a pin, formed of non-magnetic material such as brass, held alongside the thumblatch of the lock, preventing it from turning. The pin is held in that position by brackets and underneath by a support member. This support member's attachment is pivotable, and a cable is attached to it, so that from a remote position, the cable may be pulled, allowing the pin to drop out of the enclosure, in turn allowing normal use of the lock by means of a key. An extender straddles the thumblatch, so that the thumblatch can be turned from the inside of the door. The narrow portion of the extender, however, which passes through the enclosure, is relatively weaker than the pin, so that when the pin is in place, and the extender is forced, the extender will break before the pin.

8 Claims, 5 Drawing Figures

DEADBOLT LOCK PROTECTOR

BACKGROUND OF THE INVENTION

This invention relates to security and protection from unauthorized entry, and in particular to protection from unauthorized entry into relatively unattended buildings through a door having a window portion.

At the present time there is increasing interest in home security, especially considering the rising crime rate, particularly regarding crimes against property. In response to these increases, many people have installed improved lock systems and devices in order to further protect themselves.

Many have chosen to install deadbolt locks because they believe that this type of lock provides the greatest physical protection from unauthorized entry. When this type of lock is installed on a door that is relatively unattended, such as the access door of a garage or other outbuilding, however, certain problems arise. When there are windows in that door, as is commonly the case, it is a simple matter for a burglar to break out a small portion of the window, reach inside, and turn the thumblatch, unlocking the door.

Even in the case where the deadbolt lock is of the double cylinder type, the same danger exists. Experts advise that, in a garage or similar location, a key be kept near the lock so that is case of emergency an exit may be made quickly and safely. Hence again an experienced thief could break the window, find the key by feel, and let himself in with very little noise or disturbance.

This invention relates to solutions to these problems.

SUMMARY OF THE INVENTION

This invention includes a protective metal enclosure to cover the portion of the deadbolt lock inside the door. Inside the enclosure are two brackets which hold a brass pin aligned so that the thumblatch of the lock cannot turn. The pin is supported by a spring-loaded stop which, by means of a shielded cable, can be moved remotely, allowing the pin to drop out through an aperture in the enclosure, thus allowing the thumblatch to be turned from the outside by the key.

An object of the invention is to protect against unauthorized entry of a relatively unattended building, such as a garage.

Another object of the invention is provide a relatively inexpensive and simple means to protect against unauthorized entry into a building.

A more specific object of the invention is to provide an inexpensive and simple means to protect against unauthorized entry by means of breaking a window in the door and turning the thumblatch to unlock the deadbolt.

Another specific object of this invention is to provide a simple and inexpensive means to protect against unauthorized entry, by means of a locking pin inside a protective enclosure.

Other objects and advantages of the invention will appear hereinafter or be obvious.

DESCRIPTION OF THE PREFERRED EMBODIMENTS

Figure 1:
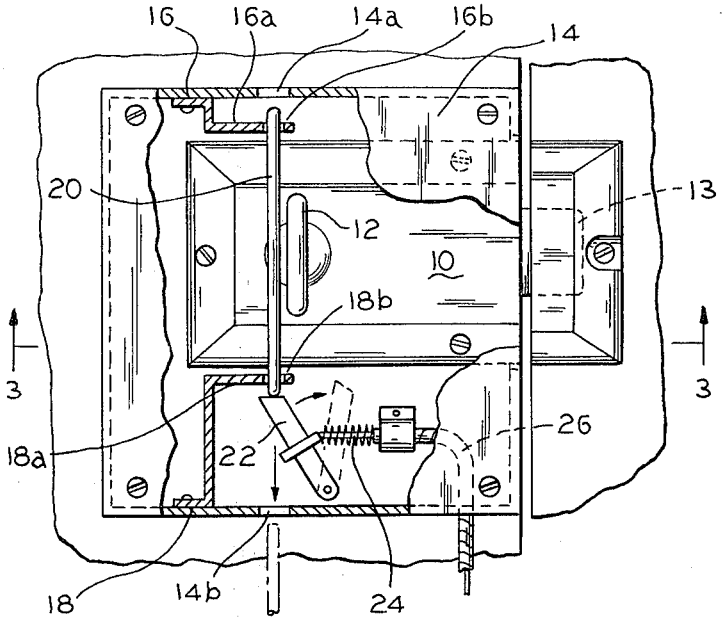
FIG. 1 is a cutaway view of the protective enclosure, showing the interior components of the invention.

Referring to FIG. 1, a conventional single cylinder deadbolt lock is shown at 10, with a conventional thumblatch 12 shown in a vertical position corresponding to the lock 10 being locked. To unlock it, thumblatch 12 must be turned away from the vertical. Lock 10 has a bolt 13 which is of the spring-loaded wedge type, so that the door can be locked simply by closing it when bolt 13 is in its protruding position.

This invention includes an outer protective enclosure 14, shown partially cut away in FIG. 1. Enclosure 14 is a rectangular metal box, the walls of which are at least thick enough to make any attempt at forcible removal noisy and time-consuming. Preferred is heavy guage steel. The depth of the box is sufficient to cover lock 10 including thumblatch 12, while the height and width are sufficient to cover the lock and the internal components of the protector.

Secured to the interior of enclosure 14 are two brackets 16 and 18, each having horizontal portions **16*a* and 18*a*. These horizontal portions have vertical holes 16*b* and 18*b* which are aligned with vertical holes 14*a* and 14*b* in enclosure 14, one in the upper surface and one in the lower surface. Hence the four holes form a vertical line, which runs alongside thumblatch 12** when it is in its vertical position.

Inserted into holes **16*a* and 18*a* is a pin 20, which is supported at its lower end by a support member 22, which in turn is pivotably attached to the lower edge of enclosure 14. The top end of support member 22, on which pin 20 rests, is angled, so that when it is leaning over in its support position, as shown by solid lines in FIG. 1, the top is horizontal. Support member 22 is also connected to an actuation cable 24, which is protected by a cover 26**, such as a small pipe or cable sheath.

Figure 2:
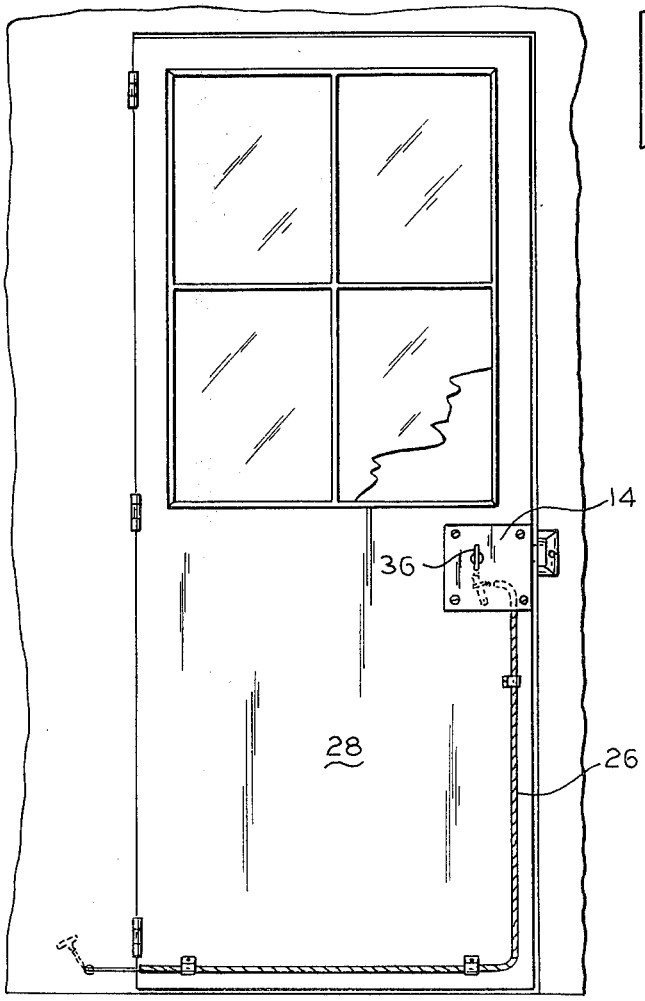
FIG. 2 is a full view of a door, showing the entire invention.
Figure 3:
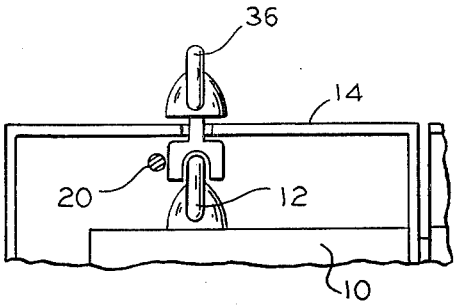
FIG. 3 is a fragmentary view of the invention, shown partially in section along line 3—3 of FIG. 1.

As shown in FIG. 2, only enclosure 14 and cable sheath 26 are visible on the inside of the door 28. Sheath 26 leads down to the lower corner of the door 28, near the hinges. There cable 24 exits the sheath and leads over to a small aperture in the wall of the building, and through to the outside. As shown in FIGS. 2 and 3, an extender 36 is permanently placed through another aperture in enclosure 14. This extender 36 has a thumblatch portion outside enclosure 14, and two leg portions inside enclosure 14, which straddle thumblatch 12, one of the legs fitting between the side of thumblatch 12 and pin 20. The narrow portion of extender 36, between the thumblatch portion and the legs, is sufficiently soft that it will twist or break before pin 20 breaks.

In operation, this invention serves to protect the deadbolt lock 10 from burglars in several ways. First, if the burglar attempts to gain entry by picking the lock, he will be prevented from doing so by pin 20, which stops thumblatch 12 from turning. If he then attempts to gain entry by breaking out a small portion of the window, as shown in FIG. 2, he is prevented from turning thumblatch 12 with his hand by enclosure 14. He is prevented from turning extender 36 by pin 20. If he attempts to force extender 36, such as with a tool, it will break as described previously, and he still will not have obtained access to the building.

When the owner wishes to gain access, on the other hand, he simply pulls cable 24, which moves support member 22 out of the way, allowing pin 20 to drop out. He then uses his key to unlock the door, since thumblatch 12 is now free to turn. From the inside, he can still pull cable 24, at the lower left corner of the door, releasing pin 20, and then turn thumblatch 12 by mean of extender 36. To lock the door again, he simply returns thumblatch 12 to its vertical position, drops pin 20 into position through hole 14*a*, and closes the door. Pin 20 is formed of brass or some other non-magnetic material so that an intruder cannot remove it through hole 14*a* by means of a magnet.

Figure 4:
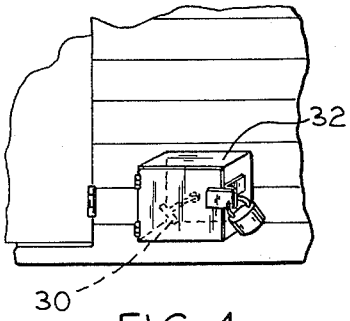
FIG. 4 is a view of a portion of the outer wall showing a lockbox covering the end of the cable.
Figure 5:
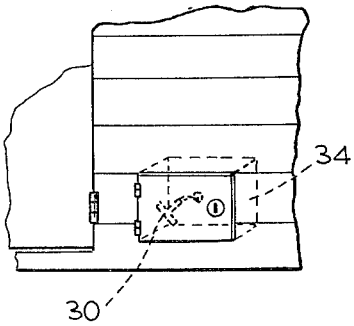
FIG. 5 is a view of a portion of the outer wall showing another type of lockbox.

FIGS. 4 and 5 show the treatment of cable 24 on the outside of the building. In the embodiment shown in FIG. 4, a small "T" device 30 is attached to the end of cable 24, inside a small lockbox 32 bolted to the outside wall. Lockbox 32 covers "T" device 30 so that it cannot be accessed without a key.

In the embodiment shown in FIG. 5, a lockbox 34 is recessed into the wall, in order to make it more difficult to attack the box itself in an attempt to gain entry. This arrangment provides somewhat greater security than that illustrated in FIG. 4, at a somewhat higher cost.

While the apparatus hereinbefore described is effectively adapted to fulfill the aforesaid objects, it is to be understood that the invention is not intended to be confined to the particular preferred embodiments of deadbolt lock protector herein set forth, inasmuch as they are susceptible of various modifications without departing from the scope of the appended claims.

What is claimed is:

1. A deadbolt lock protector, for protecting a conventional, single cylinder deadbolt lock having a thumblatch which is in the vertical position when locked and a spring-loaded wedge-type bolt, allowing the door on which the lock is mounted to be closed when the bolt is in its protruding position, comprising:

an enclosure, of sufficient size to cover the lock completely, affixed to the door covering the lock;

means for preventing the thumblatch from turning from its locked position, even when a key is inserted from the outside;

said preventing means including a pin secured vertically alongside the thumblatch to prevent it from turning, brackets secured inside said enclosure to hold said pin from moving horizontally, and a support member also inside said enclosure to hold said pin from moving vertically; and means for releasing said preventing means, so that the thumblatch may then be turned from its locked position.

2. A lock protector as recited in claim 1 wherein said releasing means includes a sheathed cable attached to said support member, said support member's attachment being pivotable, and the opposite end of said cable being located at a remote position, such that when said cable is pulled, said support member is pivoted out from under said pin, allowing said pin to drop out of said enclosure through an aperture in its bottom, which in turn allows the thumblatch to turn.

3. A lock protector as recited in claim 2 further comprising thumblatch extending means at least partially on the outside of said enclosure for turning the thumblatch when said pin is allowed to drop out of said enclosure.

4. A lock protector as recited in claim 3 wherein said extending means is relatively weaker than said pin, such that if said turning means is forced to turn while said pin is in place, said turning means will break rather than said pin.

5. A lock protector as recited in claim 4 wherein said pin is formed of non-magnetic material, such that it can be dropped into place through a hole in the top of the enclosure but cannot be withdrawn through the same hole by magnetic means.

6. A lock protector as recited in claim 5 wherein said remote end of said cable is positioned on the outside of the building of which the door is a part, such that the owner may pull it from the outside, freeing the lock, and allowing him to use his key to unlock the door.

7. A lock protector as recited in claim 6 wherein said remote end of said cable on the outside of the building is covered by a lock box attached to the exterior of the building.

8. A lock protector as recited in claim 7 wherein said remote end of said cable is covered by a lock box recessed into the wall of the building.

* * * * *